US007603070B2

(12) United States Patent
Chang et al.

(10) Patent No.: US 7,603,070 B2
(45) Date of Patent: Oct. 13, 2009

(54) HEAT ROLLER OF IMAGE FORMING APPARATUS

(75) Inventors: Hyuk-Jae Chang, Seoul (KR); Jong-Min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 441 days.

(21) Appl. No.: 11/492,052

(22) Filed: Jul. 25, 2006

(65) Prior Publication Data

US 2007/0166069 A1 Jul. 19, 2007

(30) Foreign Application Priority Data

Jan. 17, 2006 (KR) ..... 10-2006-0005119

(51) Int. Cl.
*G03G 15/20* (2006.01)
*G03G 15/00* (2006.01)

(52) U.S. Cl. ..... 399/330; 399/90

(58) Field of Classification Search ..... 399/90, 399/328, 330, 333, 335
See application file for complete search history.

(56) References Cited

U.S. PATENT DOCUMENTS 4,820,904 A * 4/1989 Urban ..... 399/335 X
6,628,917 B2 * 9/2003 Lee ..... 399/330
6,661,992 B2 * 12/2003 Lee ..... 399/330
6,847,798 B2 * 1/2005 Cho et al. ..... 399/330
6,853,833 B2 * 2/2005 Cho et al. ..... 399/330
6,898,390 B2 * 5/2005 Lee et al. ..... 399/330 X

FOREIGN PATENT DOCUMENTS

| | | |
|---|---|---|
| CN | 1388417 | 1/2003 |
| JP | 10-312128 | 11/1998 |
| JP | 10-333476 | 12/1998 |
| JP | 2001-1314990 | 11/2001 |
| JP | 2002-351256 | 12/2002 |
| KR | 10-0452874 | 10/2004 |

OTHER PUBLICATIONS

Office Action issued in Korean Patent Application No. 2006-5119 on Dec. 12, 2006.
Decision of Grant issued Jun. 21, 2007 by the Korean Intellectual Property Office for Korean Patent Application No. 2006-5119.
Chinese Office Action issued by the State Intellectual Property Office of the People's Republic of China on Feb. 13, 2009.

* cited by examiner

*Primary Examiner*—Sandra L Brase
(74) *Attorney, Agent, or Firm*—Stein McEwen, LLP

(57) ABSTRACT

A heat roller of an image forming apparatus is capable of preventing a terminal from being broken and improving contact performance of the terminal. The heat roller includes a heat transfer pipe, a heat generating body disposed at the heat transfer pipe and generating heat, a terminal to apply power to the heat generating body, and an end cap connected to the heat transfer pipe, and having a groove such that the terminal is smoothly inserted without forced bending.

36 Claims, 4 Drawing Sheets

HEAT ROLLER OF IMAGE FORMING APPARATUS

CROSS-REFERENCE TO RELATED APPLICATIONS

This application claims the benefit of Korean Application No. 2006-0005119, filed Jan. 17, 2006, in the Korean Intellectual Property Office, the disclosure of which is incorporated herein by reference.

BACKGROUND OF THE INVENTION

1. Field of the Invention

Aspects of the present invention relate to an image forming apparatus and, more particularly, to a heat roller of an image forming apparatus.

2. Description of the Related Art

Generally, types of image forming apparatus include a copier, a laser printer, a multifunctional device, or the like. Various types of image forming apparatuses, including laser printers, form an electrostatic latent image on a surface of a photoconductive drum, and fix a toner onto the electrostatic latent image, thereby forming a toner image. The toner image of the photoconductive drum is transferred to a recording medium. The toner image transferred to the recording medium passes through a fixing unit to be fixed thereto by predetermined heat and pressure.

The fixing unit includes a heat roller to generate heat, and a pressure roller contacting the heat roller to rotate therewith. The heat roller generally includes a heat pipe and a heat generating body in a heat transfer pipe. In addition, the heat roller includes end caps at both of its ends, and terminals fixed to the end caps. The terminals are connected to the heat generating body.

However, some of the image forming apparatuses have the following problems.

When the terminals are press-fitted into the end caps during assembly, the terminals may be abruptly bent during press-fitting to cause breakage or formation of cracks therein. In addition, such cracks formed in the terminal generate an arc when power is supplied, and when the heat roller is used for a long time, the arc may break the portions of the terminals in which the cracks have been generated.

Further, as the terminals may be severely deformed when the terminals are press-fitted, electric contact performance of the terminals remarkably deteriorates.

SUMMARY OF THE INVENTION

In order to lessen the effects of the foregoing and/or other problems, an aspect of the present invention has a heat roller of an image forming apparatus capable of lessening the breakage of a terminal and improving electric contact performance of the terminal.

In accordance with an aspect of the present invention, there is a heat roller of an image forming apparatus including: a heat transfer pipe; a heat generating body disposed at the heat transfer pipe and generating heat; a terminal to apply power to the heat generating body; and an end cap connected to the heat transfer pipe, and having a groove such that the terminal is smoothly inserted without forced bending.

In accordance with another aspect of the present invention, there is a heat roller of an image forming apparatus including: a heat transfer pipe; a heat generating body disposed at the heat transfer pipe and generating heat; an end cap connected to the heat transfer pipe; a conductive member; and a terminal smoothly passing through the end cap without forced bending, and having a portion that extends on an exterior surface of the end cap and applying power to the heat generating body in contact with the conductive member.

In accordance with still another aspect of the present invention, there is a heat roller of an image forming apparatus including: a heat transfer pipe; a heat generating body disposed at the heat transfer pipe and generating heat; a terminal to apply power to the heat generating body; and an end cap connected to the heat transfer pipe, and having a portion of the end cap, into which the terminal is inserted, disposed diagonally opposite to a tip of the terminal, when seen from a cross-sectional view.

In accordance with yet another aspect of the present invention, there is a fixing unit for an image forming apparatus including: a heat roller including a heat transfer pipe to apply heat to a recording medium, a heat generating body disposed at the heat transfer pipe and generating heat, a terminal to apply power to the heat generating body, and an end cap connected to the heat transfer pipe, and having a groove such that the terminal is smoothly inserted without forced bending; and a pressure roller rotating with the heat roller and pressing the recording medium to fix a toner image onto the recording medium.

In accordance with yet another aspect of the present invention, there is an image forming apparatus including: a development unit to form a toner image onto an electrostatic latent image of a photoconductive drum; a transfer unit to transfer the toner image onto a recording medium; a heat roller including a heat transfer pipe to apply heat to the recording medium, on which the toner image is printed, a heat generating body disposed at the heat transfer pipe and generating heat, a terminal to apply power to the heat generating body, and an end cap connected to the heat transfer pipe, and having a groove such that the terminal is smoothly inserted without forced bending; and a pressure roller rotating with the heat roller, and pressing the recording medium to fix a toner image to the recording medium.

The terminal has a portion that extends on an exterior surface of the end cap to improve contact performance with a conductive member.

The groove is sloped to smoothly guide the insertion of the terminal.

Further, the groove passes through the end cap from the exterior to the center thereof.

Furthermore, the groove has an inlet port wider than an outlet port, through which the terminal passes.

In addition, when seen from a cross-sectional view of the end cap, a portion of the end cap, through which the terminal is inserted, may be disposed diagonally opposite to a tip of the terminal.

In accordance with yet another aspect of the present invention, there is a heat roller of an image forming apparatus, including: a heat transfer pipe; a heat generating body disposed in the heat transfer pipe and generating heat; at least one terminal electrically connected to the heat generating body; and at least one end cap connected to the heat transfer pipe, and having a first groove formed on one side, and a second groove formed on an opposite side to the one side.

In accordance with yes another aspect of the present invention, there is an end cap connectable to a heat transfer pipe usable with a heat roller of an image forming apparatus, including a body having a first side and a second side formed opposite of body from the first side, wherein a first groove is formed on the first side, and a second groove is formed on the second side, and first groove and the second groove communicate through an opening through the interior of the body.

Additional aspect and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE EMBODIMENTS

Figure 1:
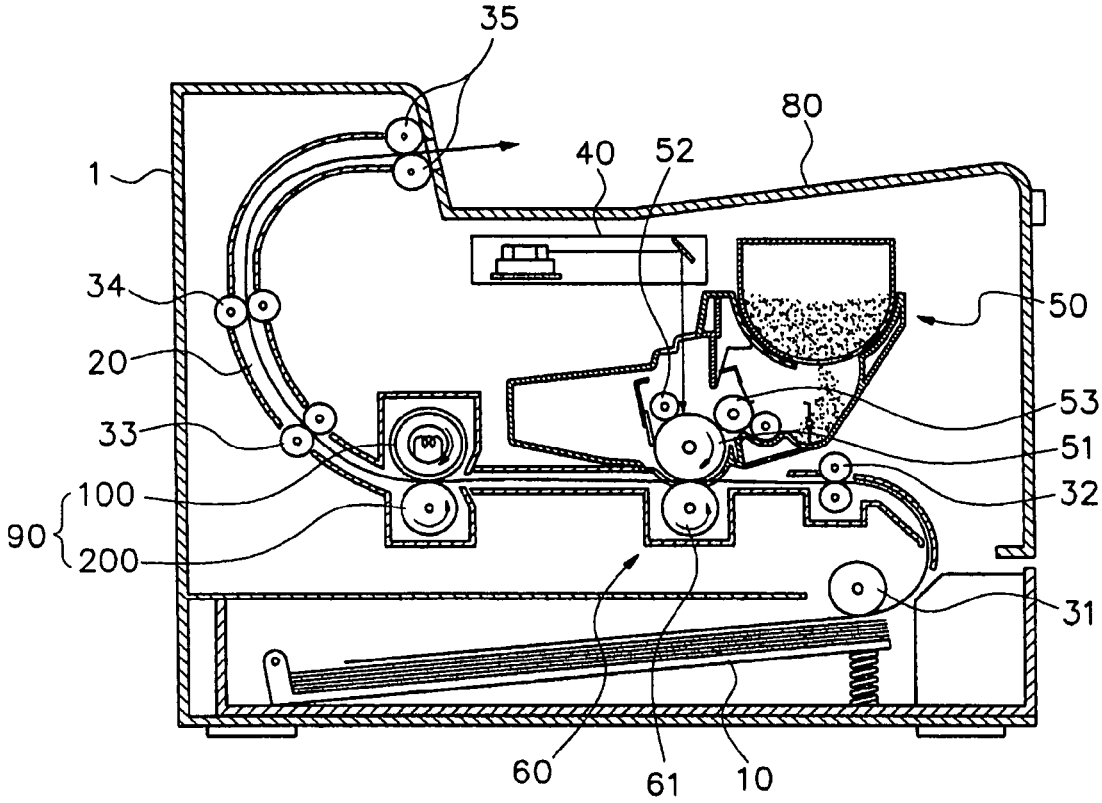
FIG. 1 is a cross-sectional view of an image forming apparatus in accordance with an aspect of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Hereinafter, an image forming apparatus in accordance with various aspects of the present invention will be described.

FIG. 1 is a cross-sectional view of an image forming apparatus in accordance with an aspect of the present invention.

An image forming apparatus may be classified into a single printer for printing an image on a single surface of a recording medium, and a duplex printer for printing images on a single surface or both surfaces of a recording medium in response to a user's selection. While the present invention may be adapted to both types, FIG. 1 illustrates a single image forming apparatus for printing an image on a single surface of a recording medium. While described in terms of a single printer, it is understood that other types of image forming apparatuses used to form images on surfaces of a recording medium are within the scope of the invention. It is also understood that examples of recording medium include paper, fabric, transparencies, or any other medium allowing an image to be fixed onto a surface of the medium.

A main body 1 of the image forming apparatus includes a paper feed cassette 10. The paper feed cassette 10 may be disposed in the main body 1 or may be detachable from the main body 1. A recording medium is stored in the paper feed cassette 10.

The main body 1 of the image forming apparatus also includes a conveyance path 20 for conveying the recording medium fed from the paper feed cassette 10, which is disposed in the main body 1. A pick-up roller 31, conveyance rollers 32, 33 and 34, a development unit 50, a transfer unit 60, a fixing unit 90, and a paper discharge roller 35 are disposed along the conveyance path 20. In addition, a laser scanning unit (LSU) 40 is disposed in the main body 1 to scan a laser onto the development unit 50. A paper discharge unit 80 is disposed at an upper portion of the main body 1. It is understood that the image forming apparatus may include all or fewer components than those described above, and may also include additional components in forming an image on the recording medium.

The development unit 50 includes a photoconductive drum 51 rotating in a certain direction, such as is shown by an arrow. A charge roller 52 is disposed to be in contact with the photoconductive drum 51 to rotate therewith. The charge roller 52 charges a surface of the photoconductive drum 51 with a certain electric potential. An electrostatic latent image is formed on the charged surface of the photoconductive drum 51 by the laser scanned from the laser scanning unit 40.

A development roller 53 is installed to be in contact with the photoconductive drum 51 to rotate therewith. The development roller 53 attaches toner to the electrostatic latent image formed on the surface of the photoconductive drum 51 to form a toner image.

Meanwhile, the transfer unit 60 includes a transfer roller 61. The transfer roller 61 is installed to be in contact with the photoconductive drum 51 to rotate therewith, such as is shown by an arrow. The transfer roller 61 rotates with the photoconductive drum 51, on which the toner image is formed, to transfer the toner image onto a surface of a recording medium. The recording medium, onto which the toner image is transferred, is conveyed to the fixing unit 90. The recording medium, onto which the image is fixed by the fixing unit 90, is discharged through the paper discharge unit 80 by a paper discharge roller 35. In FIG. 1, reference numerals 100 and 200 designate a heat roller and a pressure roller, respectively.

Figure 2:
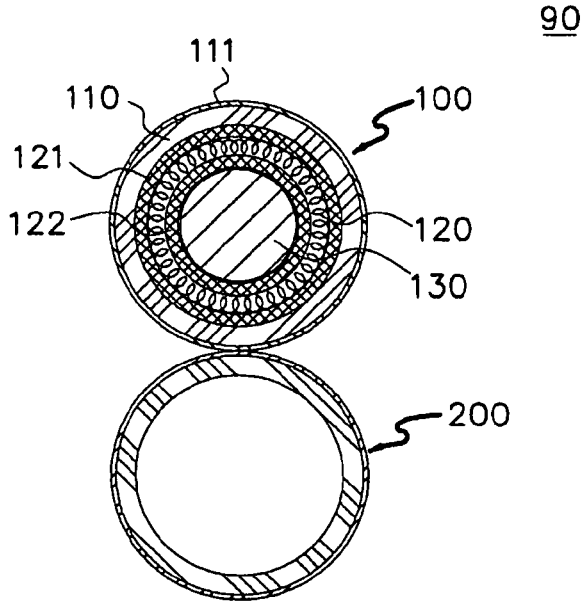
FIG. 2 is a cross-sectional view of a fixing unit of the image forming apparatus shown in FIG. 1.
Figure 3:
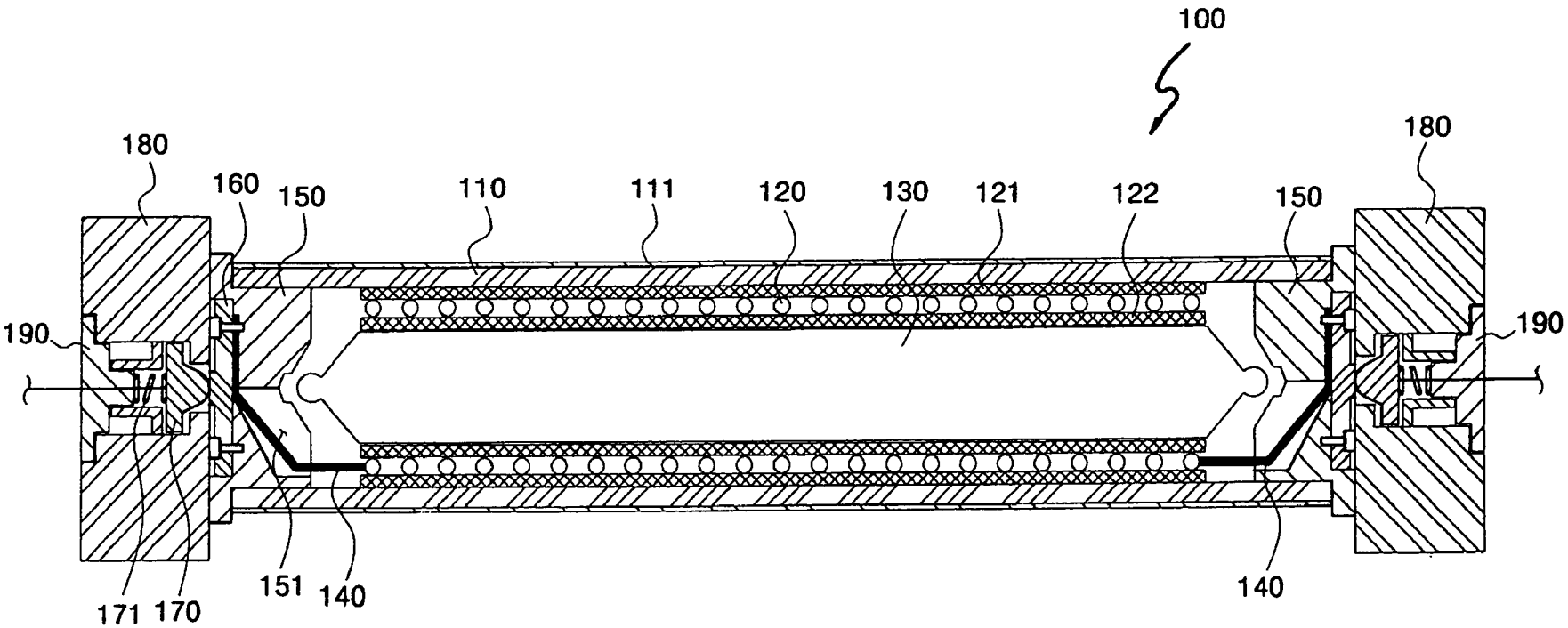
FIG. 3 is a cross-sectional view of a heat roller of the fixing unit shown in FIG. 2.

FIG. 2 is a cross-sectional view of the fixing unit 90 of an image forming apparatus shown in FIG. 1, and FIG. 3 is a cross-sectional view of the heat roller 100 of FIG. 2.

Referring to FIGS. 2 and 3, the fixing unit 90 includes the heat roller 100 for applying heat to the recording medium, and the pressure roller 200 rotating with the heat roller 100 to press the recording medium. The heat roller 100 is disposed in contact with a surface of the recording medium, on which an image is printed.

The heat roller 100 includes a heat transfer pipe 110 for applying heat to the recording medium to fix the image thereto, in this aspect of the present invention. The heat transfer pipe 110 has two open ends. The heat transfer pipe 110 is formed of an aluminum alloy having high thermal conductivity. In addition, a coating layer 111 formed of synthetic resin is coated on an outer surface of the heat transfer pipe 110. The coating layer 111 may be formed of Teflon having high heat-resistance and thermal conductivity. It is understood that in other aspects of the present invention, the heat transfer pipe 110 may have one open end.

The heat transfer pipe 110 contains a heat generating body 120 for generating heat. The heat generating body 120 may be a coil for generating heat using electric resistance. The coil is wound in or on the heat transfer pipe 110 in a spiral manner (see FIG. 2).

A heat pipe 130 is disposed in the heat generating body 120. A working fluid (not shown) is filled in the heat pipe 130. The working fluid is heated by the heat generating body 120. The heated working fluid heats the heat transfer pipe 110 uniformly and rapidly. The heat of the heat generating body 120 is transferred in a non-contact manner to the heat transfer pipe 110 by the heat pipe 130. Since the structure of the heat pipe 130 will be appreciated by those skilled in the art, its description will be omitted. In addition, FIG. 2 illustrates the heat pipe 130 disposed at a center portion of the heat roller 100 as shown in a hatched manner.

A first insulating layer 121 is disposed between the heat transfer pipe 110 and the heat generating body 120. In addition, a second insulating layer 122 is disposed between the heat generating body 120 and the heat pipe 130. The first insulating layer 121 prevents current of the heat generating body 120 from flowing to the heat transfer pipe 110. In addition, the second insulating layer 122 prevents the current of the heat generating body 120 from flowing to the heat pipe 130.

Terminals 140 and end caps 150 are attached to both ends of the heat transfer pipe 110. In addition, insulating gears 180 are engaged with the end caps 150. The insulating gears 180 rotate the heat roller 100 by power transmission members (not shown).

Brushes 170 are disposed in the insulating gears 180 for connecting an external power supply to conductive members 160. The brushes 170 are supported by springs 171 to be in contact with the conductive members 160, without rotation, although the insulating gears 180 rotate. The brushes 170 may be in point contact with the conductive members 160 to reduce friction force therebetween. For this purpose, the brushes 170 have rounded contact surfaces. In addition, fixing members 190 are disposed in the insulating gears 180 to support the springs 171. The fixing members 190 also do not rotate. In addition, power lines are connected to the brushes 170 through the fixing member 190. The power lines are shown with solid lines in FIG. 3.

Hereinafter, structures pertaining to individual terminal 140 and the end cap 150 of the heat roller 100 will now be described.

Figure 4:
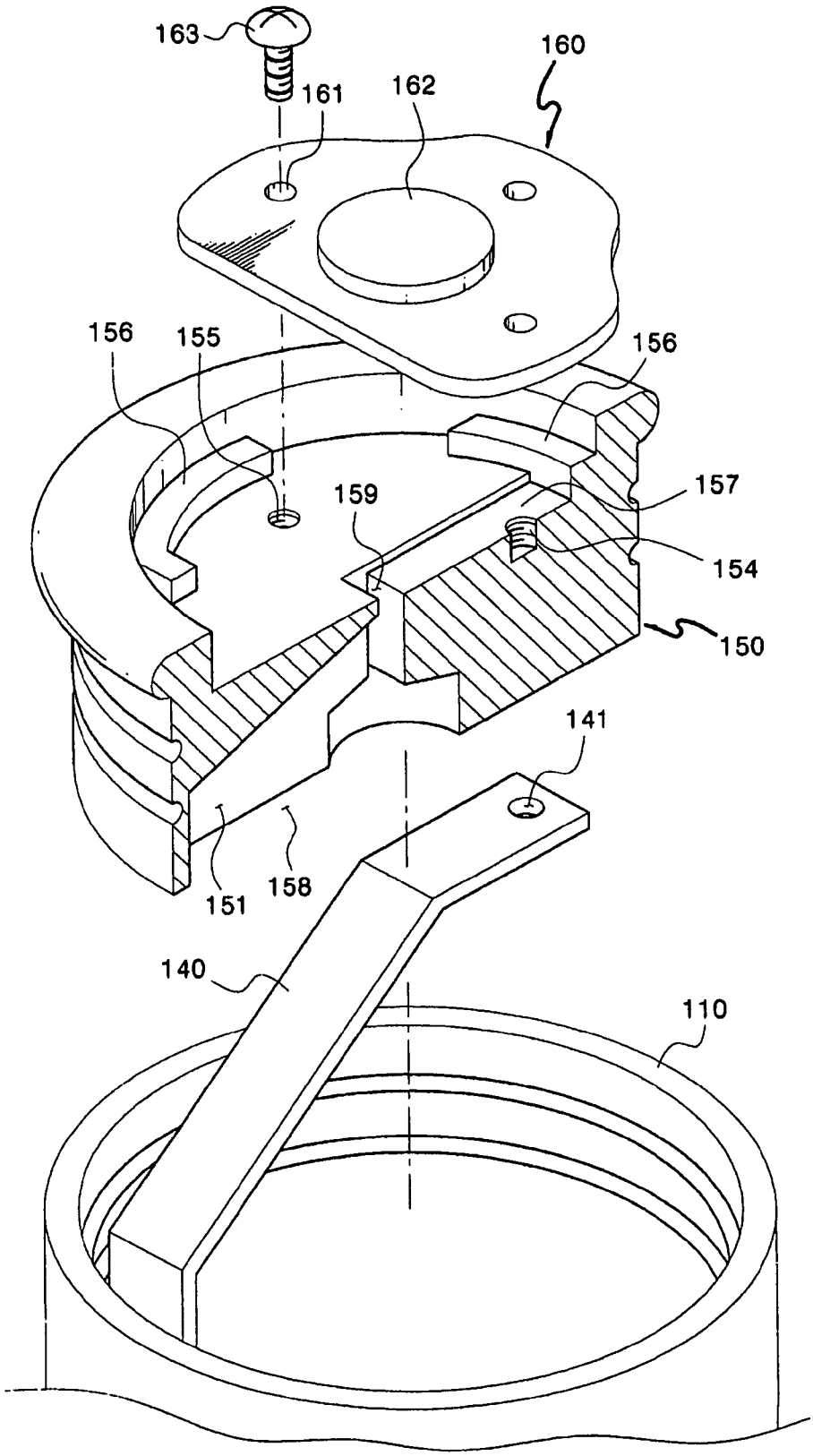
FIG. 4 is an exploded perspective view of the heat roller shown in FIG. 3.
Figure 5:
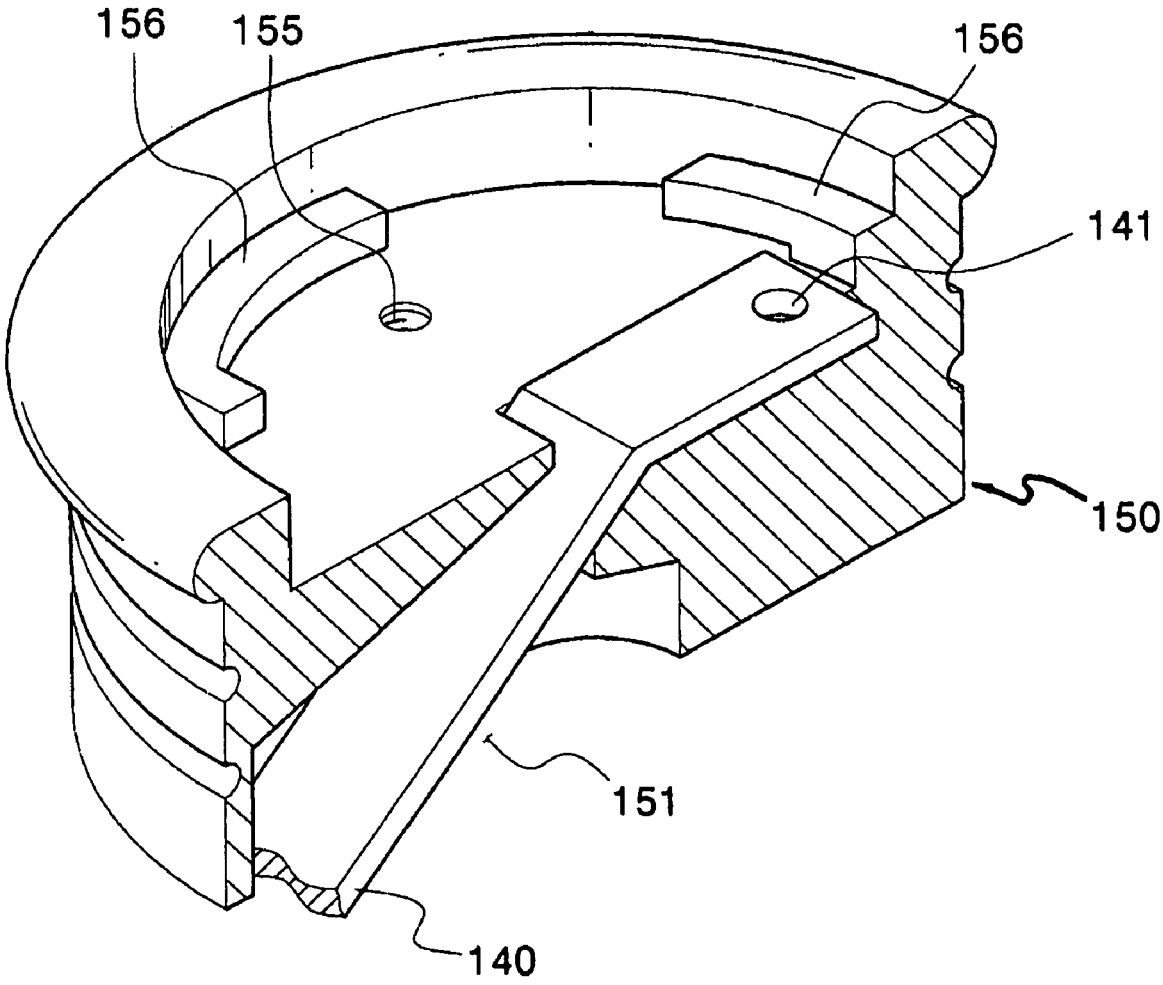
FIG. 5 is a perspective view showing the state in which a terminal is connected to an end cap in the heat roller shown in FIG. 3.

FIG. 4 is an exploded perspective view of the heat roller 100 shown in FIG. 3, and FIG. 5 is a perspective view showing the state in which a terminal is connected to an end cap in a heat roller 100 shown in FIG. 3.

Referring to FIGS. 4 and 5, the terminal 140 is disposed in the heat transfer pipe 110, and connected to both ends of the heat generating body 120. In this aspect of the present invention, the terminal 140 extends from the heat transfer pipe 110. Each of the terminals 140 has a body portion (indicated with reference number 140) and a tip portion (near reference number 141) connected to the body portion. The terminal 140 is formed of a material having high conductivity. In this aspect of the present invention, the body portion is sloped, and the tip portion is level. Nevertheless, in other aspect of the present invention, the body portion may have a curvature, may have a sharp bend, and/or an angled corner. Similarly, the tip portion may have a slope, a curvature, and/or an angled corner.

In addition, the end cap 150 is formed to be inserted into one or both ends of the heat transfer pipe 110 to hermetically seal the interior of the heat transfer pipe 110. The end cap 150 is formed of an insulating material such as synthetic resin, plastic, ceramic, or the like, or any combination thereof. In this aspect of the present invention, the end cap 150 is shown as being generally cylindrical. Nevertheless, other shapes or forms may be used to form the end cap 150 to achieve insertion of the end cap 150 into the heat transfer pipe 110, and to hermetically seal the interior of the heat transfer pipe 110.

Each of the end caps 150 has a groove 151 for smoothly inserting the terminal 140. In this aspect of the present invention, the groove 151 has a slope for this purpose. In FIG. 4, reference numeral 151 designates a groove, reference numeral 158 designates a portion of the groove 151 through which the terminal 140 is introduced, and reference numeral 159 designates a portion of the groove 151 through which the terminal 140 is extracted to emerge on the other side of the end cap 150 from the portion 158. The groove 151 is formed on one of the sides of the end cap 150, which in this aspect of the present invention is shown as the bottom side of the end cap 150 in FIG. 4. The groove 151 is formed to slope in a radial direction of the end cap 150. In other aspects of the present invention, the groove 151 may have a curvature, and/or a sharp bend.

In this aspect of the present invention, the groove 151 is formed to pass through the center or an interior portion of the end cap 150 beginning from the exterior of the end cap 150. In addition, a mounting portion 157 connected to the groove 151 to mount a tip of the terminal 140 is formed at one surface of the end cap 150. The surface of the end cap 150 having the mounting portion 157 is on the side opposite from the side of the end cap 150 with the groove 151. The mounting portion 157 has a groove shape for accommodating the tip of the terminal end 140. In this aspect of the present invention, the mounting portion 157 does not have a slope. Instead, it is level and is formed to have a constant depth into the side of the end cap 150. The groove 151 and the mounting portion 157 communicate through the portion 159 formed through the interior of the end cap 150. Although as shown in this aspect of the invention as being a level or non-sloping, the mounting portion 157 may be formed with a slope, a curvature, and/or a sharp bend. As, discussed above, a tip portion of the terminal 140 will be mounted to the mounting portion 157. Thus, the mounting portion 157 is formed to correspond to the tip portion of the terminal 140 or vice versa, so that sufficient contact with a conductive member 160 is obtained by the tip portion of the terminal 140, as will be discussed below.

In addition, the groove 151 may have a larger width in the portion 158, through which the terminal 140 is introduced, than in the portion 159, through which the terminal 140 is extracted. In other words, in this aspect of the present invention, the groove 151 is tapered in a depth direction of the end cap 150. The portion 158 being wider than the portion 159 further eases insertion of the terminal 140 into the groove 151.

Further, when seen from a cross-sectional view, the portion 158 of the end cap 150, through which the terminal 140 is introduced, and the tip of the terminal 140 may be disposed at both diagonal ends of the end cap 150. As described above, the portion 158 of the end cap 150, through which the terminal 140 is introduced, is disposed as far as possible from the tip of the terminal 140. With this arrangement, the groove 151 and the mounting portion 157 are on opposite sides of the end cap 150 in terms of radial and axial directions. In other words, the groove 151 and the mounting portion 157 are opposed about the center of the end cap 150, in this aspect of the present invention. Nevertheless, it is understood that the groove 151 and the mounting portion 157 may be opposed about another point of the end cap 150, which may be off-centered.

In this aspect of the present invention, a fixing hole 154 is formed at a surface (an upper surface in FIG. 3) of the end cap 150 to fix the terminal 140 to the end cap 150. In addition, an insertion hole 141 is formed at the tip of the terminal 140 to correspond to the fixing hole 154. Further, the end cap 150 has at least one coupling hole 155. Each of the fixing hole 154 and the coupling holes 155 has a female thread. Furthermore, the end cap 150 has a guide 156 formed at its periphery. It is understood that in other aspects of the present invention, the end cap 150 may be fixed to the terminal 140 using adhesives, and/or other fasteners, which may not require the use of the insertion hole 141, the fixing hole 154, and/or the coupling holes 155. In other aspects of the present invention, the terminal 140 may be used to latch itself onto the end cap 150, for example, by being tightly fitted and/or by using friction.

Meanwhile, a conductive member 160 for fixing the terminal 140 and applying power to the terminal 140 is disposed at the end cap 150. In this aspect of the present invention, the conductive member 160 has a plate shape. The conductive member 160 has fastening holes 161 corresponding to the fixing hole 154 and the coupling holes 155 of the end cap 150. It is understood that the shape of the conductive member 160 may be any other shape as long as the conductive member 160 is able to fix the terminal 140 to the end cap 150 and apply power to the terminal 140. The possible shapes may be rectangular, oval, or multisided, for example.

The conductive member 160 is guided by the guide 156 to be mounted on a certain position. In FIG. 3, the guide 156 is disposed at a position corresponding to a convex portion of the periphery of the conductive member 160. However, the position of the guide 156 may be variously changed depending on the shape of the conductive member 160.

In addition, the conductive member 160 has an approximately circular contact portion 162 on its outer surface to be in contact with the brush 170 (see FIG. 3). In this aspect of the present invention, the contact portion 162 is raised above the plane of the conductive member 160, but it is understood that the contact portion 162 may be level with the plane or may even all or partially recede into the plane of the conductive member 160. It is also understood that in other aspects of the present invention, the shape of the contact portion 162 need not be circular, and any shaped surface may be used as long as sufficient contact surfaces are provided. The optional surface shapes may be rectangular, oval, or multisided, for example.

A process of fastening the end cap 150 to the heat roller 100 in accordance with an aspect of the present invention will now be described.

Each 140 connected to each ends of the heat generating body 120 are exposed at, and extend from, each ends of the heat transfer pipe 110. Each of the terminals 140 passes through the groove 151 of the end cap 150.

As the groove 151 of the end cap 150 has a slope, in this aspect of the present invention, the terminal 140 is readily inserted into the end cap 150, without needing to be forcibly pressed. In addition, when seen from a cross-sectional view of the end cap 150, the portion 158 of the end cap 150, through which the terminal 140 is introduced, is disposed diagonally opposite to the tip of the terminal 140. Therefore, the terminal 140 is smoothly inserted into the groove 151, without forced bending of the terminal 140. Once inserted, the body portion (indicated by reference number 140) of the terminal 140 is received in the groove 151, while the tip portion (near reference number 141) of the terminal 140 is fitted into the mounting portion 157.

Moreover, as the groove 151 has a large width at the introduction portion 158 of the terminal 140, the terminal 140 is easily inserted into the groove 151.

When the terminal 140 is inserted into the groove 151, the tip of the terminal 140 is exposed on a surface of the end cap 150 in a radial direction. Therefore, the contact area between the terminal 140 and the conductive member 160 can be increased.

To complete the mounting of the terminal 140 to the end cap 150 in this aspect of the present invention, the terminal 140 passes through the end cap 150, and the terminal 140 is mounted on the mounting portion 157 by at least the tip portion. Next, after the conductive member 160 is placed on the end cap 150, the fastening members 163 are fastened to the fastening holes 161 of the conductive member 160 and the fixing hole 154 and the coupling holes 155 of the end cap 150. When the conductive member 160 is fastened to the end cap 150, the conductive member 160 presses the terminal 140 to stably fix the terminal 140 to the end cap 150. It is understood that in other aspects of the present invention, the conductive member 160 may be fixed to the end cap 150 using adhesives, and/or other fasteners, which may not require the use of the fasteners 163, fastening holes 161, the fixing hole 154, or the coupling holes 155. In other aspects of the present invention the conductive member 160 may be latched onto the end cap 150, for example, by being tightly fitted and/or by using friction.

When the end cap 150 is assembled to the conductive body 160, the heat transfer pipe 110 is fastened to the insulating gear 180 as shown in FIG. 3. At this time, the conductive member 160 is in contact with the brush 170. The brush 170 is installed to be in contact with the conductive member 160 by a resilient force of the spring 171. The spring 171 is supported by the fixing member 190.

As can be seen from the foregoing, in accordance with an aspect of the present invention, a groove is formed at the end cap in a sloped manner so that a terminal can be inserted into the groove without forced and/or further bending during the insertion. Therefore, it is possible to lessen cracks from occurring in the terminal, and thus, to lessen the chance of the terminal from being broken due to an arc.

In addition, the tip of the terminal is exposed on the end cap as much as possible to increase contact performance between the terminal and a conductive member.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A heat roller of an image forming apparatus comprising:
- a heat transfer pipe;
- a heat generating body disposed at the heat transfer pipe and generating heat;
- a terminal that extends from the heat generating body, to apply power to the heat generating body; and
- an end cap connected to the heat transfer pipe, and having a groove such that the terminal is smoothly inserted without forced bending.

2. The heat roller according to claim 1, further comprising a conductive member, wherein a portion of the terminal extends on an exterior surface of the end cap to improve contact performance with the conductive member.

3. The heat roller according to claim 1, wherein the groove is sloped to smoothly guide the insertion of the terminal.

4. The heat roller according to claim 1, wherein the groove passes through the end cap from the exterior to the center thereof.

5. The heat roller according to claim 1, wherein the groove has an inlet port wider than an outlet port, through which the terminal passes.

6. The heat roller according to claim 1, wherein, when seen from a cross-sectional view of the end cap, a portion of the end cap, into which the terminal is inserted, is disposed diagonally opposite to a tip of the terminal.

7. A heat roller of an image forming apparatus comprising:
- a heat transfer pipe;
- a heat generating body disposed at the heat transfer pipe and generating heat;
- an end cap connected to the heat transfer pipe;
- a conductive member; and
- a terminal extending from the heat generating body, smoothly passing through the end cap without forced bending, and having a portion that extends on an exterior surface of the end cap and applying power to the heat generating body in contact with the conductive member.

8. A heat roller of an image forming apparatus comprising:
- a heat transfer pipe;

a heat generating body disposed at the heat transfer pipe and generating heat;

a terminal to apply power to the heat generating body; and an end cap connected to the heat transfer pipe, and having a portion of the end cap, into which the terminal is inserted, disposed diagonally opposite to a tip of the terminal, when seen from a cross-sectional view.

9. The heat roller according to claim 8, further comprising a conductive member, wherein a portion of the terminal extends on an exterior surface of the end cap to improve contact performance with the conductive member.

10. The heat roller according to claim 8, wherein the end cap has a groove that is sloped to smoothly guide the insertion of the terminal.

11. The heat roller according to claim 10, wherein the groove has an inlet port wider than an outlet port, through which the terminal passes.

12. A fixing unit of an image forming apparatus, comprising:

a heat roller including a heat transfer pipe to apply heat to a recording medium, a heat generating body disposed at the heat transfer pipe and generating heat, a terminal that extends from the heat generating body, to apply power to the heat generating body, and an end cap connected to the heat transfer pipe, and having a groove such that the terminal is smoothly inserted without forced bending; and a pressure roller rotating with the heat roller and pressing the recording medium to fix a toner image to the recording medium.

13. The fixing unit according to claim 12, further comprising a conductive member, wherein a portion of the terminal extends on an exterior surface of the end cap to improve contact performance with the conductive member.

14. The fixing unit according to claim 12, wherein the groove is sloped to smoothly guide the insertion of the terminal.

15. The fixing unit according to claim 12, wherein the groove has an inlet port wider than an outlet port, through which the terminal passes.

16. The fixing unit according to claim 12, wherein, when seen from a cross-sectional view of the end cap, a portion of the end cap, into which the terminal is inserted, is disposed diagonally opposite to a tip of the terminal.

17. An image forming apparatus comprising:

a development unit to form a toner image onto an electrostatic latent image of a photoconductive drum;

a transfer unit to transfer the toner image onto a recording medium;

a heat roller including a heat transfer pipe to apply heat to the recording medium, on which the toner image is printed, a heat generating body disposed at the heat transfer pipe and generating heat, a terminal that extends from the heat generating body, to apply power to the heat generating body, and an end cap connected to the heat transfer pipe, and having a groove such that the terminal is smoothly inserted without forced bending; and a pressure roller rotating with the heat roller, and pressing the recording medium to fix a toner image onto the recording medium.

18. The image forming apparatus according to claim 17, further comprising a conductive member, wherein a portion of the terminal extends on an exterior surface of the end cap to improve contact performance with the conductive member.

19. The image forming apparatus according to claim 17, wherein the groove is sloped to smoothly guide the insertion of the terminal.

20. The image forming apparatus according to claim 17, wherein the groove has an inlet port wider than an outlet port, through which the terminal passes.

21. A heat roller of an image forming apparatus, comprising:

a heat transfer pipe;

a heat generating body disposed in the heat transfer pipe and generating heat;

at least one terminal that extends from the heat generating body, and is electrically connected to the heat generating body; and at least one end cap connected to the heat transfer pipe, and having a first groove formed on one side, and a second groove formed on an opposite side to the one side.

22. The heat roller according to claim 21, wherein the first groove and the second groove communicate through an opening through the interior of the at least one end cap.

23. The heat roller according to claim 21, wherein the first groove is tapered in a depth direction of the at least one end cap so that the terminal is easily inserted into the first groove.

24. The heat roller according to claim 21, wherein the first groove is sloped in a radial direction of the at least one end cap.

25. The heat roller according to claim 21, wherein the second groove is level to a surface of the opposite side and exposed in a radial direction of the at least one end cap.

26. The heat roller according to claim 21, wherein the first groove and the second groove are on opposite sides both in radial and axial directions of the at least one end cap.

27. The heat roller according to claim 21, wherein the at least one terminal extends from the heat transfer pipe and includes a body portion and a tip portion connected to the body portion.

28. The heat roller according to claim 27, wherein the at least one terminal is received into the first groove and the tip portion of the at least one terminal is fitted in the second groove.

29. The heat roller according to claim 21, wherein the at least one end cap hermetically plugs an end of the heat transfer pipe.

30. The heat roller according to claim 21, further comprising at least one conductive member having a plate shape and a raised contact portion.

31. The heat roller according to claim 21, wherein the at least one end cap further comprises a guide formed on the opposite side of the at least one end cap to allow a conductive member to be mounted to the at least one end cap.

32. The heat roller according to claim 21, further comprising:

an insulating gear engaged with the at least one end cap;

a brush disposed in the interior of the insulating gear, which is in contact with the at least one conductive member and does not rotate relative to the at least one conductive member;

a spring supporting the brush; and a fixing member disposed in the insulating gears to support the spring, and which does not rotate relative to the at least one conductive member.

33. A fixing unit of an image forming apparatus, comprising:

the heat roller according to claim 21; and a pressure roller rotating with the heat roller to press a recording medium therebetween to fix a toner image to the recording medium.

34. An image forming apparatus, comprising:

a development unit to form a toner image onto an electrostatic latent image of a photoconductive drum;

a transfer unit to transfer the toner image onto a recording medium;

the heat roller according to claim 21; and a pressure roller rotating with the heat roller to press a recording medium therebetween to fix a toner image to the recording medium.

35. An end cap connectable to a heat transfer pipe usable with a heat roller of an image forming apparatus, comprising a body having a first side and a second side formed opposite of the body from the first side, wherein a first groove is formed on the first side, and a second groove is formed on the second side, and the first groove and the second groove communicate through an opening through the interior of the body, wherein the first groove is sloped in a radial direction of the end cap.

36. The end cap according to claim 35, wherein the second groove is level to a surface of the opposite side.

* * * * *

UNITED STATES PATENT AND TRADEMARK OFFICE

CERTIFICATE OF CORRECTION

PATENT NO. : 7,603,070 B2
APPLICATION NO. : 11/492052
DATED : October 13, 2009
INVENTOR(S) : Chang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 521 days.

Signed and Sealed this

Fifth Day of October, 2010

David J. Kappos

David J. Kappos
*Director of the United States Patent and Trademark Office*